US011721495B2

(12) United States Patent
Yoon et al.

(10) Patent No.: US 11,721,495 B2
(45) Date of Patent: Aug. 8, 2023

(54) ELECTRO-THERMALLY ACTUATED MECHANICAL SWITCHING DEVICE AND MEMORY DEVICE USING SAME

(71) Applicant: Samsung Electronics Co., Ltd., Suwon-si (KR)

(72) Inventors: Jun-Bo Yoon, Daejeon (KR); Pan Kyu Choi, Daejeon (KR); Yong Bok Lee, Daejeon (KR); Subon Kim, Daejeon (KR); Suhyun Kim, Daejeon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 238 days.

(21) Appl. No.: 16/942,445

(22) Filed: Jul. 29, 2020

(65) Prior Publication Data

US 2022/0020540 A1 Jan. 20, 2022

(30) Foreign Application Priority Data

Jul. 16, 2020 (KR) ..... 10-2020-0087976

(51) Int. Cl.
*H01H 1/00* (2006.01)
*H01H 1/62* (2006.01)
*H01H 1/14* (2006.01)

(52) U.S. Cl.
CPC ..... *H01H 1/0094* (2013.01); *H01H 1/62* (2013.01); *H01H 1/14* (2013.01); *H01H 2231/002* (2013.01); *H01H 2239/06* (2013.01)

(58) Field of Classification Search
USPC ..... 337/12
See application file for complete search history.

(56) References Cited

U.S. PATENT DOCUMENTS

2009/0207717 A1* 8/2009 van Kampen ..... G11C 11/50 369/126
2012/0031744 A1* 2/2012 Naito ..... H01H 59/0009 200/181

FOREIGN PATENT DOCUMENTS

JP 2004328561 A 11/2004
KR 1020060081038 A 7/2006
(Continued)

OTHER PUBLICATIONS

Office Action dated Jun. 30, 2022 from the Korean Intellectual Property Office for Corresponding Korean Application KR 10-2020-0087976.
(Continued)

*Primary Examiner* — Rexford N Barnie
*Assistant Examiner* — Xuan Ly
(74) *Attorney, Agent, or Firm* — Muir Patent Law, PLLC

(57) ABSTRACT

A switching device in accordance with the present invention includes a first electrode and a second electrode, and the second electrode includes a body part and a cantilever connected to the body part. In addition, one end of a the cantilever comes into contact with the first electrode by an electrostatic force generated by a voltage applied to the first electrode and the second electrode, and the one end of the cantilever is separated from the first electrode due to heat generated by a voltage applied to both ends of the body part. In addition, the second electrode may include a 2-1 electrode, a 2-2 electrode, and an engineered beam connected in between. The engineered beam comes into contact with the first electrode on the basis of thermal expansion due to heat generated by a current flowing between the body part of the 2-1 electrode and the body part of the 2-2 electrode, or is separated from the first electrode on the basis of thermal expansion due to heat generated by a current flowing through both ends of the body parts of the 2-1 electrode and
(Continued)

the 2-2 electrode. According to the present invention, it is possible to achieve high-speed operation while having ultralow power, high reliability through exploiting nano thermal actuation method capable of high-speed thermal expansion and actuation at low operation voltage.

13 Claims, 10 Drawing Sheets

(56) References Cited

FOREIGN PATENT DOCUMENTS

| | | | |
|---|---|---|---|
| KR | 1020070001366 | A | 1/2007 |
| KR | 100717870 | B1 | 5/2007 |
| KR | 101901212 | B1 | 9/2018 |

OTHER PUBLICATIONS

Notice of Allowance dated Jan. 17, 2023 issued by the Korean Intellectual Property Office for corresponding KR Patent Application No. 10-2020-0087976.

* cited by examiner (a)

(b)

(c)

ELECTRO-THERMALLY ACTUATED MECHANICAL SWITCHING DEVICE AND MEMORY DEVICE USING SAME

CROSS-REFERENCE TO RELATED APPLICATION

This application claims priority to Korean Patent Application No. 10-2020-0087976 filed on Jul. 16, 2020 and all the benefits accruing therefrom under 35 U.S.C. § 119, the contents of which are incorporated by reference in their entirety.

BACKGROUND

The present disclosure relates to an electrothermally actuated mechanical switching device and a memory device using same, and more particularly, to an electrothermally actuated mechanical switching device, which has high reliability and a low operation voltage, and is capable of high-speed operation through a nano thermal actuation method, and a memory device using the same.

Semiconductors have fundamental limitations such as sub-threshold swing (SS) limited to approximately 60 mV/dec, high waiting power and a decrease in CPU clock due to the same, and unstableness in harsh environments, and the semiconductor memories based on the semiconductors also have the same limitations. Such limitations are further intensified according to scaling.

In particular, amounts of leak currents increase as the sizes of semiconductor devices decrease and a great many devices are mounted, and in order to solve the limitations of resulting heat generation, methods for intentionally lowering the CPU speed have also been proposed, but these caused other limitations such as degradation in performance.

Unlike this, electrostatically actuated mechanical memories have near-zero SS and static power consumption and high stability in harsh environments. However, there are limitations in that when mechanical memories become smaller to nano sizes, realizable electrostatic force also becomes extremely small and the mechanical memories have high contact resistance and thus have limits of low reliability, high operation voltages, and slow operation speeds.

Mechanical devices have been continuously studied after first proposed in 1978, but had difficulty in replacing metal oxide semiconductors (MOSFETs) due to the small electrostatic force at nano sizes, which results in large contact resistance, and therefore, generates high heat between the two contact surfaces. Additional limitations of the conventional mechanical devices include high actuation voltages and slow operation speed. Although devices using an electrothermal actuation method have been introduced to overcome the high operation voltage requirement of the electrostatically actuated devices, there still remains limitations of large power consumption and low operation speed.

Thus, research and development for a mechanical device having a novel actuating method that is capable of overcoming low reliability, high operation voltages, and low operation speeds while maintaining the advantage of mechanical memories (near-zero SS, low waiting power, and high stability under harsh environment) is in demand.

SUMMARY

The present disclosure is derived considering the aforementioned limitations and provides an electrothermally actuated mechanical switching device having high reliability and low operation voltage, which are achieved by employing a nano electrothermal actuation method that allows ultralow power operation and high-speed thermal expansion and enables operation at high-speed and application as a memory device.

In accordance with an exemplary embodiment of the present invention, a switching device includes a first electrode and a second electrode including a body part and a cantilever connected to the body part, wherein one end of the cantilever comes into contact with the first electrode by an electrostatic force generated by a voltage applied to the first electrode and the second electrode, or the one end of the cantilever is separated from the first electrode by heat generated by a voltage applied to both ends of the body part.

In accordance with another exemplary embodiment of the present invention, a switching device includes a first electrode and a second electrode including a 2-1 electrode, a 2-2 electrode, and an engineered beam, wherein: the engineered beam is connected to a concave body part of the 2-1 electrode and a concave body part of the 2-2 electrode; the engineered beam comes into contact with the first electrode on the basis of thermal expansion due to heat generated by a current flowing between the body part of the 2-1 electrode and the body part of the 2-2 electrode, or the engineered beam is separated from the first electrode on the basis of thermal expansion due to heat generated by a current flowing through both ends of the body part of the 2-1 electrode and thermal expansion due to heat generated by a current flowing through both ends of the body part of the 2-2 electrode.

Meanwhile, in accordance with another exemplary embodiment of the present invention, a memory device includes a first electrode and a second electrode disposed above the first electrode and operates in a programmed state or an erased state according to an electrostatic force or heat generated by a voltage applied to at least one among the first and second electrodes.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
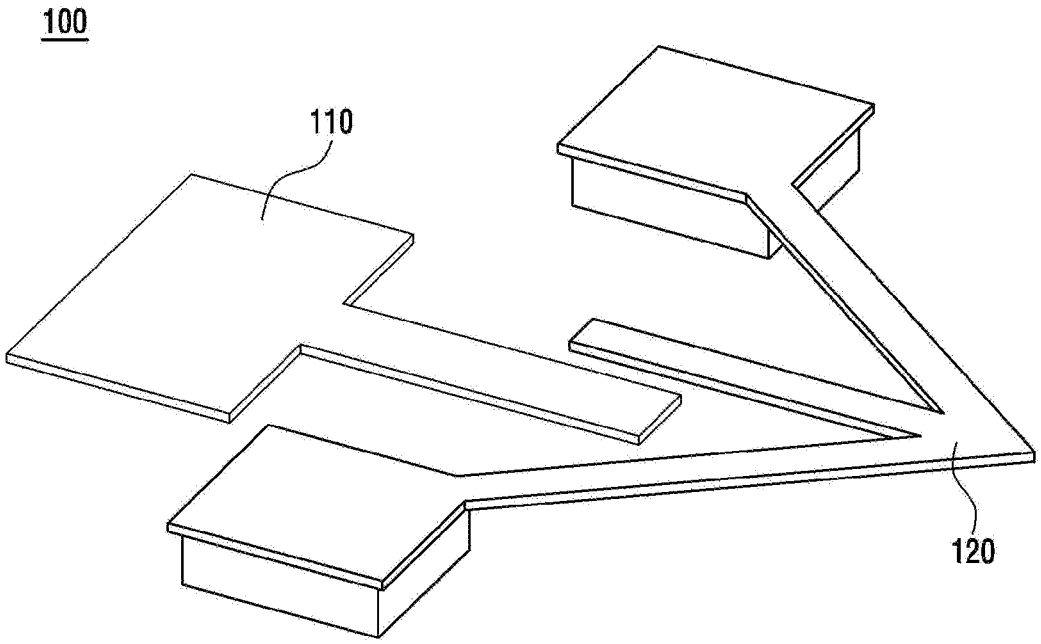
FIG. 1 is a schematic view of a switching device in accordance with an exemplary embodiment of the present invention.

The detailed description of the invention to be provided later refers to the accompanying drawings that exemplarily illustrates a specific embodiment in which the invention may be implemented. These embodiments will be described in sufficient detail to enable those skilled in the art to practice the invention. It is to be understood that various embodiments of the present invention are different from each other but need not be mutually exclusive. For example, specific shapes, structures and characteristics disclosed in the present invention provided herein may be implemented in other embodiments without departing from the spirit and scope of the present invention in relation to one embodiment. In the drawings, similar reference symbols indicate the same or similar function in many aspects.

Figure 2:
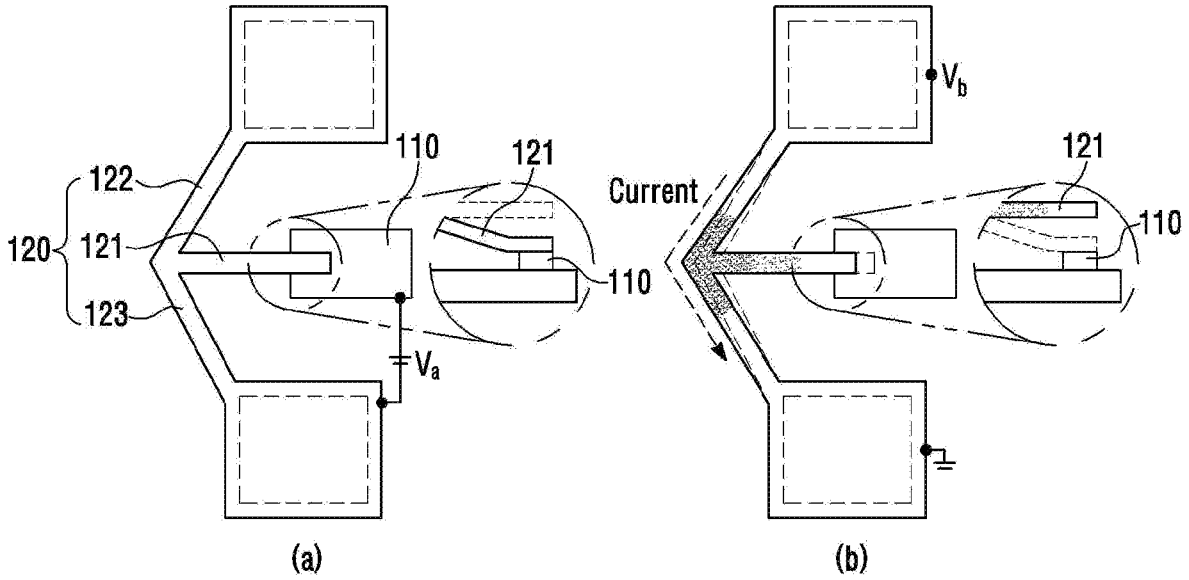
FIG. 2 is a view for illustrating an operation of a switching device in accordance with an exemplary embodiment of the present invention.

Hereinafter, the present disclosure will be described in detail with reference to accompanying drawings. FIG. 1 is a schematic view of a switching device in accordance with an exemplary embodiment of the present invention, and FIG. 2 is a view for illustrating operation of a switching device in accordance with the exemplary embodiment of the present invention. As illustrated in FIG. 1, a switching device 100 including a first electrode 110 and a second electrode 120 is switched on through electrostatic actuation, and is switched off through electrothermal actuation.

The plane on which the first electrode 110 is disposed is different from the plane on which the second electrode 120 is disposed, and the second electrode 120 is disposed above the first electrode 110. The switching device 100 illustrated in FIG. 1 may be manufactured through processes of patterning a first electrode material, depositing and flattening a sacrificial layer, depositing and patterning a second electrode material, and removing the sacrificial layer, but the embodiment of the present invention is not limited thereto. At this point, various materials such as molybdenum (Mo), tungsten (W), tantalum (Ta), cobalt (Co), silicon carbide (SiC), platinum (Pt), gold (Au), copper (Cu), nickel (Ni), chromium (Cr), titanium (Ti), rhodium (Rh), palladium (Pd) may be used as the electrode material, but the embodiment of the present invention is not limited to any specific material.

The second electrode 120 includes body parts 122 and 123 and a cantilever 121 connected to the body parts 122 and 123.

At this point, the body parts 122 and 123 have a concave shape. In FIGS. 1 and 2, the body parts 122 and 123 are illustrated only in a V-shape structure, but may also be formed in a C-shape structure bent in a streamline shape in another embodiment, and the concave regions may be formed in structures bent at a right angle. However, the V-shape structures will be specifically described below for convenience in description.

As illustrated in FIGS. 1 and 2, the body parts 122 and 123 may have a V-shape structure in which a first member 122 and a second member 123 have their ends mutually connected in the lengthwise direction thereof and form an acute angle. The cantilever 121 is a lengthwise member protruding from the connection point of the first member 122 and the second member 123. That is, one end of the cantilever 121 protrudes from the vertex (intersection point of the first member 122 and the second member 123) of the V-shape body parts 122 and 123. FIGS. 1 and 2 illustrate that the angle formed by the first member 122 and the cantilever 121 and the angle formed by the second member 123 and the cantilever 121 are the same, but the angles may also be mutually different according to the size, usage, performance or the like of devices. Of course, when the body parts 122 and 123 are formed in a C-shape structure bent in a streamline shape and the concave region is bent at a right angle, the first member 122 and the second member 123 may be implemented as a single member and also be divided into three or more members. This is only for describing the structure, and the number of components of the body part does not limit the scope of the present invention.

The one end of the cantilever 121 is connected to the vertex of the V-shape body parts 122 and 123 and the other end floats in a state of being spaced a predetermined distance above the first electrode 110. Accordingly, the other end of the cantilever 121 may come into contact with and be connected to the first electrode 110 when moving vertically downward.

FIG. 2(*a*) illustrates a switch-on state, that is, a programmed state. A switching device 100 in accordance with the present invention has a first electrode 110 and a second electrode 120 which are physically separated, and when a voltage Va of no less than an operation voltage is applied between the second electrode 120 that is the upper electrode and the first electrode 110 that is the lower electrode, the first electrode 110 and the second electrode 120 come into mechanical contact due to electrostatic force, and thus, current flows. More specifically, the current flows between the first electrode 110 and the second electrode 120, while the other end of the cantilever 121 moves downward and comes into contact with the first electrode 110.

FIG. 2(*b*) illustrates a switch-off state, that is, an erased state. When a voltage Vb of no less than the operation voltage is applied to the second electrode 120 that is the upper electrode, and more specifically, between the first member 122 and the second member 123 that extend in mutually opposite directions with respect to the one end of the cantilever 121, current flows in the concave body parts 122 and 123 and thermal expansion occurs due to joule heat. The other end of the cantilever 121 is separated from the first electrode 110 due to the force of thermal expansion.

Figure 3:
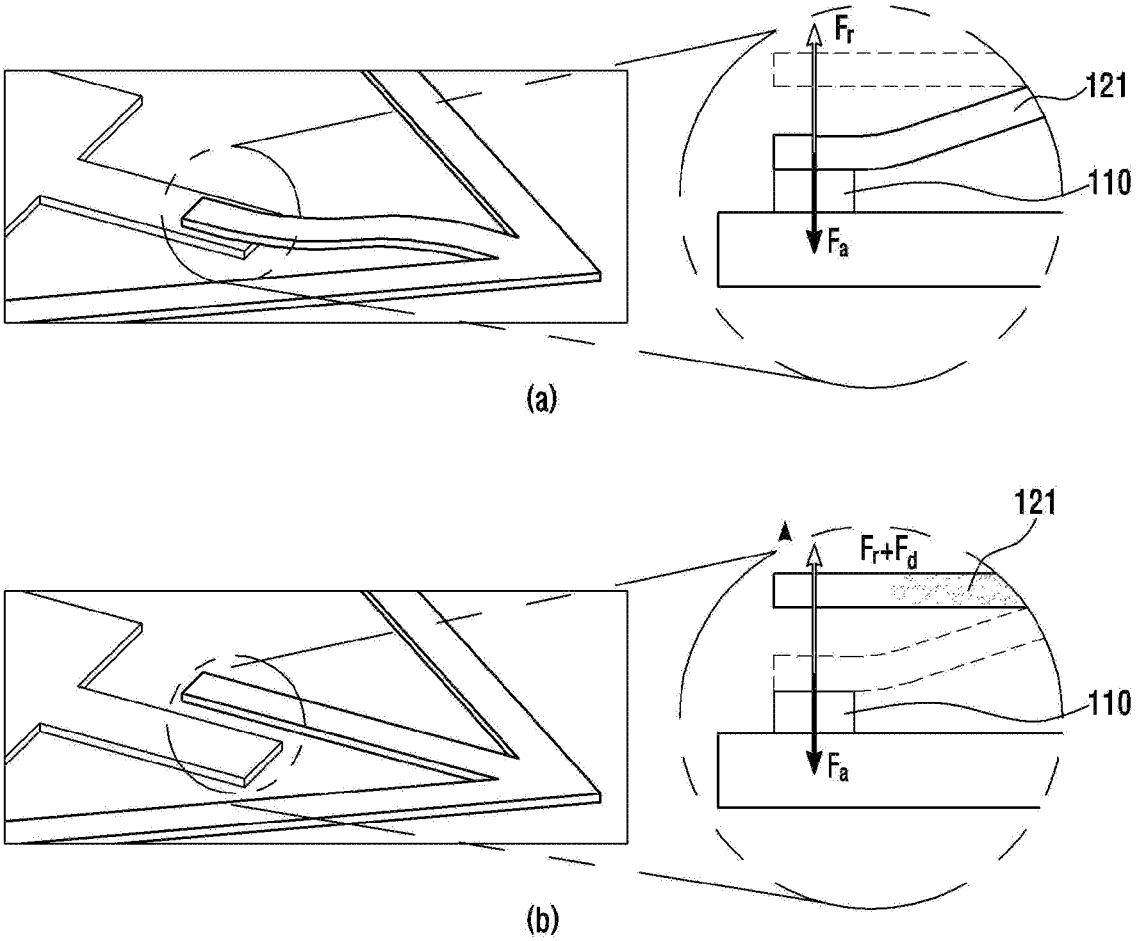
FIG. 3 illustrates forces acting on a switching device in a switching state in accordance with an exemplary embodiment of the present invention.

FIG. 3 illustrates forces acting on a switching device in a switching state in accordance with an exemplary embodiment of the present invention.

FIG. 3(*a*) illustrates a switch-on state, that is, a programmed state. In the switch-on state, a mechanical contact is induced through an electrostatic force between the first electrode 110 and the second electrode 120 that are physically separated, and at this point, since the restoring force Fr of the second electrode 120 is weaker than the adhesion force Fa between the two electrodes 110 and 120, the first electrode 110 and the second electrode 120 remain in the contact state due to stiction even after removing the voltage Va. That is, the adhesion force Fa between the two electrodes 110 and 120 allows the programmed state to be maintained.

FIG. 3(*b*) illustrates a switch-off state, that is, an erased state. When a voltage Vb no less than the operation voltage is applied to the body parts 122 and 123 and thermal expansion occurs due to joule heat, the sum of restoration force Fr of the second electrode 120 and the thermal expansion force Fd become larger than the adhesion force Fa, the stiction phenomenon is overcome, and the first electrode 110 and the second electrode 120 are separated.

Typical mechanical memories required high voltage because programming and erasing actuation were performed using actuation electrode and separation electrode, respectively, and a high actuation voltage was required for both types of operation. In particular, even higher voltages of approximately 10-40V were required for the erasing actuation, and thus, it was difficult to replace semiconductor devices despite the excellent characteristics unique to the mechanical memories. However, since the switching device in accordance with the present invention performs erase actuation through electrothemal method, the switching device no longer requires high actuation voltage.

Figure 4:
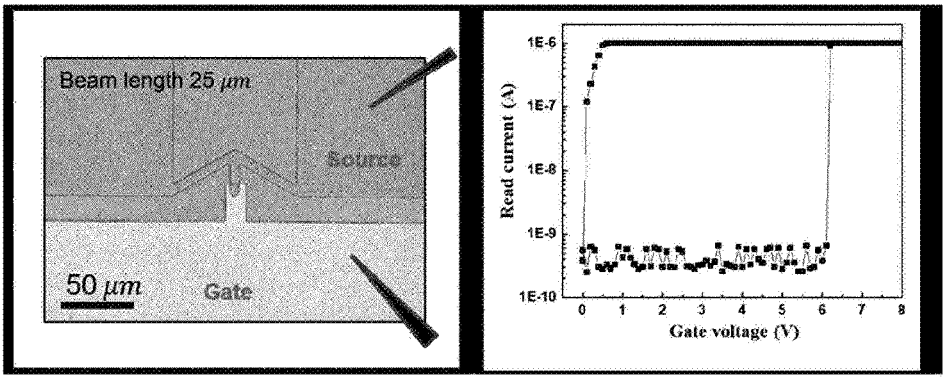
FIG. 4 illustrates results of an operation experiment of a switching device in accordance with an exemplary embodiment of the present invention.
Figure 4:
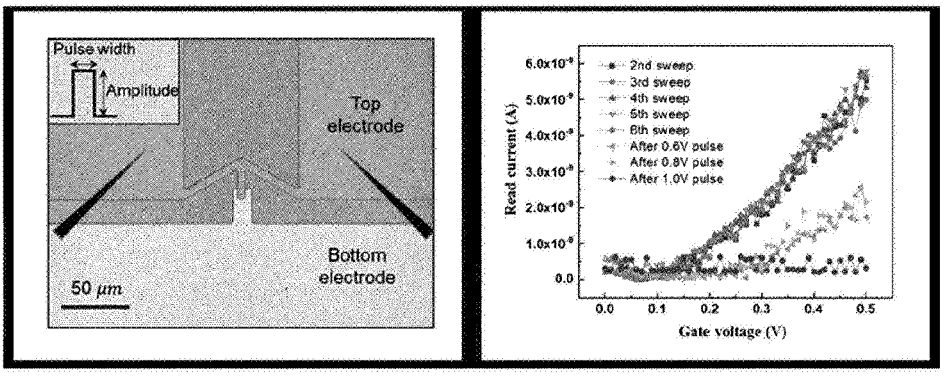
Figure 4:
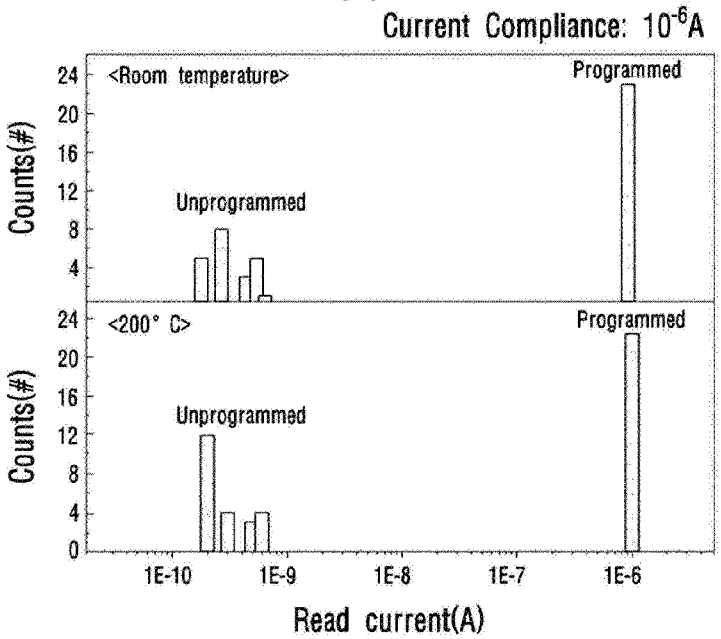

FIG. 4 illustrates results of an operation experiment of a switching device in accordance with an exemplary embodiment of the present invention.

In FIG. 4(*a*), a current flow was detected when a voltage of approximately 6.2 V was applied between the first electrode 110 and the second electrode 120 and was then gradually decreased. In the graph of FIG. 4(*a*), x-axis means the amplitude of the applied voltage, and y-axis means the amplitude of flowing current. As can be found in the graph of FIG. 4(*a*), when the voltage was gradually decreased from approximately 6.2 V, it could be found that current flows until reaching approximately 0 V, confirming that the contact between the cantilever 121 of the second electrode 120 and the first electrode 110 was maintained, and the programmed state was maintained.

In FIG. 4(*b*), a voltage was applied to body parts 122 and 123 of the second electrode 120 and erasing actuation due to joule heating was confirmed. As can be found in the graph of FIG. 4(*b*), when a voltage of approximately 1.0 V was applied between the first electrode 110 and the second electrode 120, it was confirmed that the cantilever 121 of the second electrode 120 was completely separated from the first electrode 110, which demonstrated the successful realization of the erase actuation.

In addition, it was also confirmed that when actuation voltages of approximately 0.6 V and 0.8 V were applied, the first electrode 110 and the second electrode 120 were only partially separated and had different resistance. Such results suggest that the switching device 100 in accordance with the present invention has possibility as a multi-bit memory.

In the switching device 100 in accordance with the present invention, erasing actuation is implemented at a voltage no greater than approximately 1.0 V as confirmed by an electrical measurement and a visual analysis through a surface profiler. That is, there is a merit of being capable of operating at a remarkably lower voltage than typical electrostatically actuated mechanical memory that requires high actuation voltage of approximately 10-40 V.

FIG. 4(*c*) illustrates a high-temperature environment stability experiment result with respect to the switching device 100 in accordance with the present invention. Programmed 23 devices and unprogrammed 23 devices were exposed under an environment of the room temperature and approximately 200° C. for approximately 30 minutes, and whether to operate in a normal operation was checked. Consequently, it was confirmed that the programmed 23 devices and unprogrammed 23 devices all maintained initial states thereof. In addition, it was confirmed that the devices normally performed the programming and erasing operations even after being exposed to the high-temperature environment. That is, the switching device 100 in accordance with the present invention may stably maintain the original state even under a high-temperature environment through utilization of adhesion force and a mechanical structure design.

Figure 5:
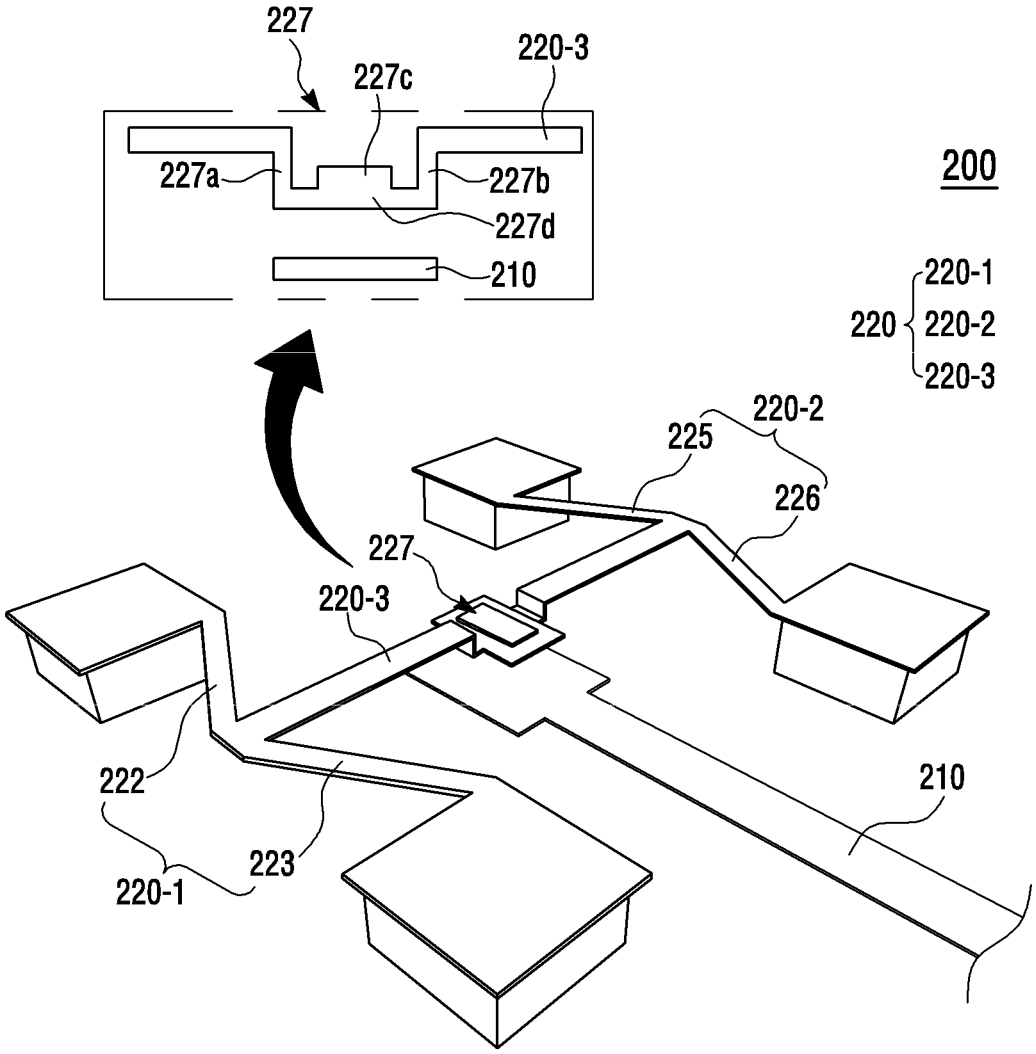
FIG. 5 illustrates a switching device in accordance with another exemplary embodiment of the present invention.

FIG. 5 illustrates a switching device in accordance with another exemplary embodiment of the present invention. As illustrated in FIG. 5, a switching device 200 in accordance with the present invention includes a first electrode 210 and a second electrode 220. The plane on which the first electrode 210 is disposed is different from the plane on which the second electrode 220 is disposed, and the second electrode 220 is disposed above the first electrode 210. The switching device 200 illustrated in FIG. 5 may be manufactured through processes of patterning a first electrode material, depositing and flattening a first sacrificial layer, patterning the first sacrificial layer and depositing a second sacrificial layer, depositing and patterning a second electrode material, and removing the sacrificial layer, but the embodiment of the present invention is not limited thereto. Various materials may be used for the above-mentioned materials for electrodes.

At this point, the second electrode 220 includes a 2-1 electrode 220-1 and a 2-2 electrode according to an embodiment described above, and an engineered beam 220-3 is connected between the 2-1 electrode 220-1 and the 2-2 electrode 220-2. The engineered beam 220-3 is a linear structure having predetermined width and thickness.

The 2-1 electrode 220-1 and the 2-2 electrode 220-2 have concave body parts. In FIG. 5, the body parts of the 2-1 electrode 220-1 and the 2-2 electrode 220-2 are illustrated only in V-shape structures, but may be formed in C-shape structures bent in streamline shapes, and may also be formed in structures bent in right angle. However, the V-shape structures will be specifically described below for convenience in description.

The body parts 222 and 223 of the 2-1 electrode 220-1 are composed of a first member 222 and second member 223 which have their ends mutually connected lengthwise, and the first member 222 and the second member 223 may form a specific angle.

Likewise, the body parts 225 and 226 of the 2-2 electrode 220-2 are composed of a first member 225 and second member 223, which have their ends mutually connected lengthwise, and the first member 225 and the second member 226 may form a specific angle.

According to the shapes of the body part of the 2-1 electrode 220-1 and the body part of the 2-2 electrode 220-2, the angles formed by the first members 222 and 225 and the second members 223 and 226 may be different, and the shapes of the first members 222 and 225 and the second members 223 and 226 may be formed variously in linear shapes, curve shapes, bent shapes, or the like.

The engineered beam 220-3 may be connected between a concave region of the 2-1 electrode 220-1 and a concave region of the 2-2 electrode 220-2. The concave region may be a region having the deepest valley, but the embodiment of the present invention is not limited thereto, and may be a position having a predetermined distance from the deepest valley. If having V-shape body parts, the engineered beam 220-3 may connect the vertex (intersection point of the first member 222 and the second member 223) of the V-shape body part of the 2-1 electrode 220-1 and the vertex (intersection point of the first member 225 and the second member 226) of the V-shape body part of the 2-2 electrode 220-2.

At this point, the engineered beam 220-3 connected between the 2-1 electrode 220-1 and the 2-2 electrode 220-2 moves downward by electrothermal actuation, and comes into contact with the first electrode 210, which is disposed at a predetermined distance therefrom, and is brought into a programmed state, and the engineered beam moves upward again by electrothermal actuation, separating from the first electrode and is brought into an erased state.

Although the second electrode 220 has been described in part as the 2-1 electrode 220 and the 2-2 electrode, and the engineered beam 220-3 positioned at the center has been described to connect the 2-1 electrode 220-1 and the 2-2 electrode 220-2, this merely divides and describes the components in order to clearly describe the structure, and all components (the 2-1 electrode 220-1, the 2-2 electrode 220-2, and the engineered beam 220-3) may be formed in one body. In that case, in describing the structure of the second electrode 220, the structure may be described as first and second concave body parts and a linear part connected in between.

Referring again to FIG. 5, a contact part 227 is provided to the engineered beam 220-3 of the switching device 200. As illustrated in the expanded view of FIG. 5, the contact part 227 may be provided in a predetermined region of the engineered beam 220-3 connected between the 2-1 electrode 220-1 and the 2-2 electrode 220-2. The predetermined region may be the right center in the entire length of the engineered beam 220-3, but may also mean a position having a predetermined distance from the right center.

The contact part 227 is a region coming into contact with the first electrode 210 when the engineered beam 220-3 moves downward, and is illustrated as a rectangular shape in FIG. 5, but may be formed of various shapes (circle, triangle, pentagon, hexagon, and the like) having a predetermined area.

Meanwhile, a contact surface 227*d* of the contact part 227 may be disposed on a plane positioned below the plane on which the 2-1 electrode 220-1, the 2-2 electrode 220-2 and the engineered beam 220-3 are disposed. Specifically, a 2-1 stepped part 227*a* and a 2-2 stepped part 227*b*, which extend to be bent vertically downward with respect to the lengthwise direction of the engineered beam 220-3, may be formed on the engineered beam 220-3, and the contact surface 227*d* of the contact part 227 may be disposed between the 2-1 stepped part 227*a* and the 2-2 stepped part 227*b*.

In addition, the engineered beam may further include a dimple part 227*c* protruding from the upper surface of the contact part 227, more specifically, from the upper surface of the contact surface 227*d* of the contact part 227 and having a predetermined area. In FIG. 5, the dimple part 227*c* has a rectangular shape, but may also have various shapes such as a circle or a triangle. That is, the switching device 200 in accordance with the present invention has a characteristic of further having the dimple part 227*c* on the engineered beam.

Figure 6:
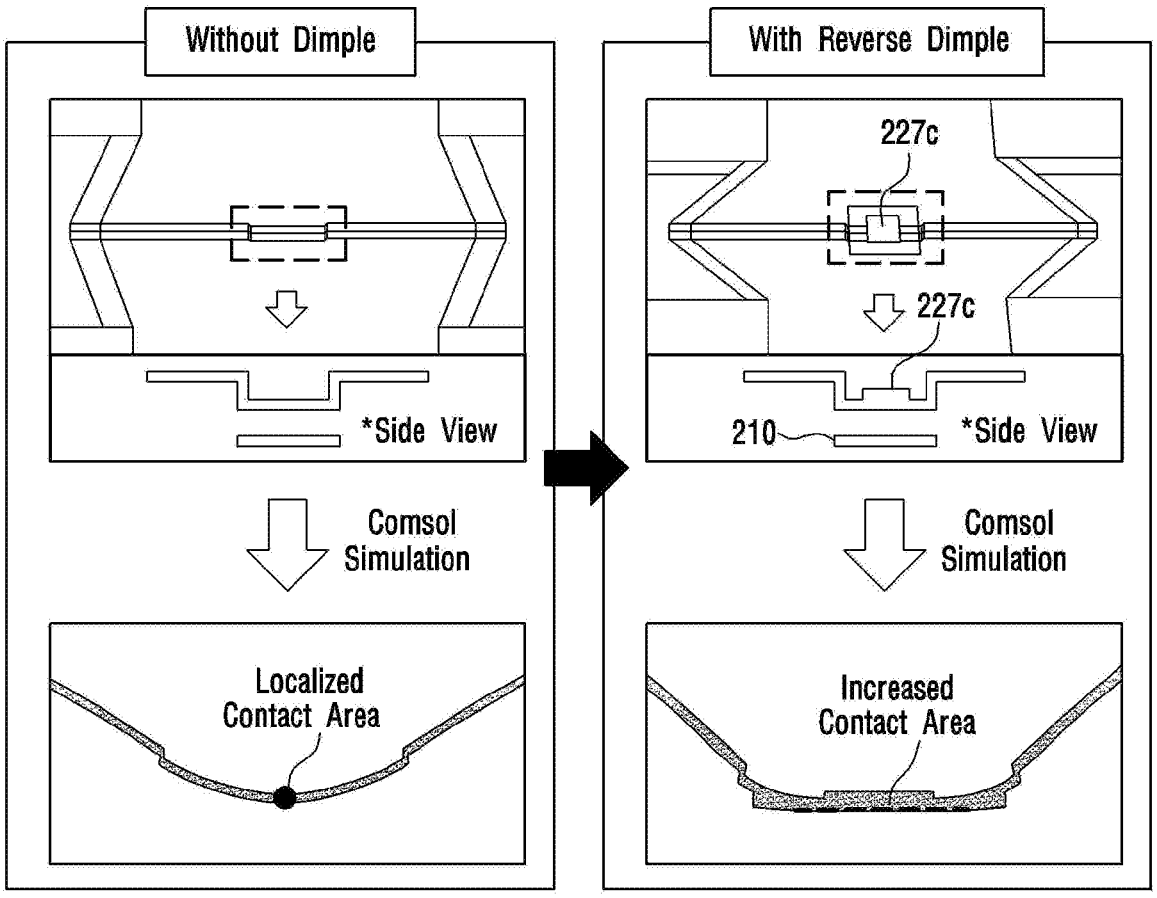
FIG. 6 illustrates an effect according to provision of a contact part of a switching device in accordance with an exemplary embodiment of the present invention.

FIG. 6 illustrates an effect according to provision of a contact part of a switching device 200 in accordance with the present invention. As described above, the contact part 227 has the dimple part 227*c* protruding upward from the upper surface thereof, and FIG. 6 illustrates contact areas when a contact part 227 is provided and is not provided.

As illustrated in the left side of FIG. 6, when a contact part 227 having a dimple part 227*c* is not provided, an engineered beam 220-3 has a local contact area while being bent downward. The smaller the size of the device, the more difficult the control of the contact area.

On the other hand, as illustrated in the right side of FIG. 6, when a contact part 227 having a dimple part 227*c* is provided, the contact part having a predetermined area provided on an engineered beam 220-3 maintains a flat shape, and thus, the contact area increases. In particular, the dimple part 227*c* provided on the upper surface of the contact part 227 further limits the bending and deformation of the contact part 227, and therefore may ensure an improved contact area.

Figure 7:
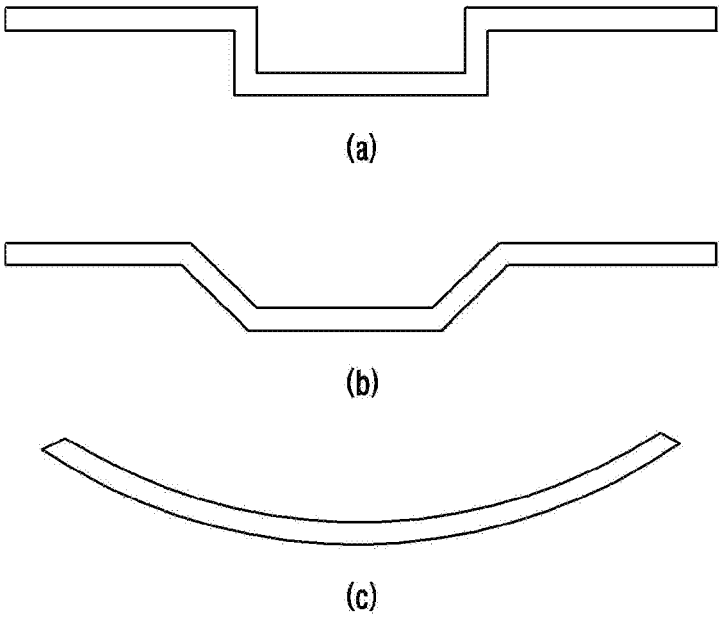
FIG. 7 illustrates various shapes of contact parts of switching devices in accordance with an exemplary embodiment of the present invention.

FIG. 7 illustrates various shapes of contact parts of switching devices in accordance with the present invention. As described above, FIG. 7(*a*) illustrates that a contact surface is provided between a 2-1 stepped part 227*a* and a 2-2 stepped part 227*b* that extend to be bent vertically downward with respect to the lengthwise direction of the engineered beam 220-3.

In FIG. 7(*b*), the 2-1 stepped part 227*a* and the 2-2 stepped part 227*b* each has an inclined shape so as to have a predetermined angle with respect to the extension direction of the engineered beam 220-3. Even in such cases, the same technical effect as that in FIG. 6 may be achieved.

Meanwhile, the contact part of a switching device in accordance with the present invention may be formed in a curved surface having a predetermined curvature without a stepped part as illustrated in FIG. 7(*c*).

FIG. 7 illustrates only the shape of a contact part, but the above-mentioned dimple part may of course be provided on the upper surface of the contact part.

Figure 8:
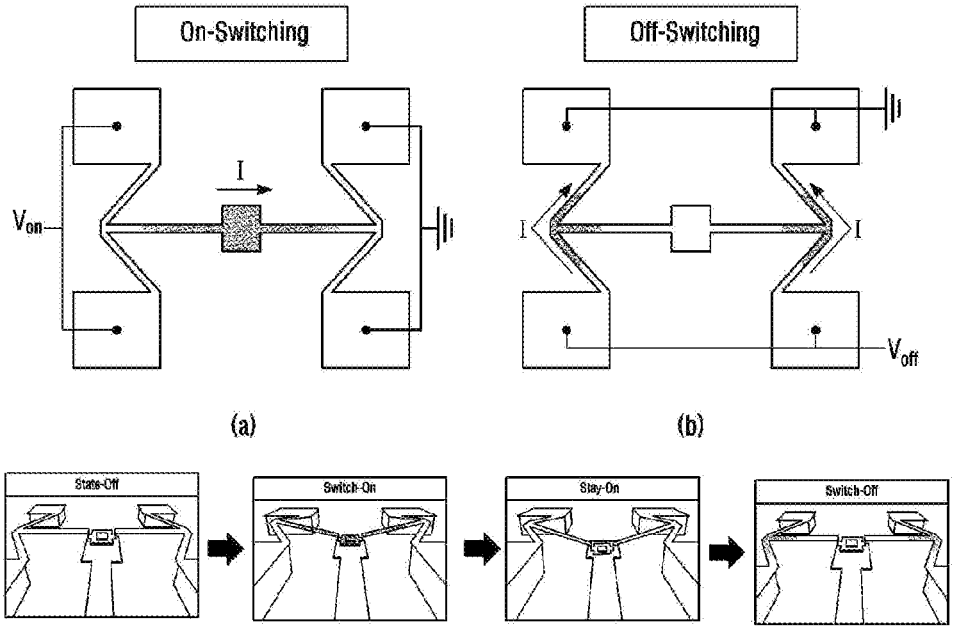
FIG. 8 is a view for illustrating an operation of a switching device in accordance with an exemplary embodiment of the present invention.

FIG. 8 is a view for illustrating an operation of a switching device in accordance with the present invention. The switching device 200 illustrated in FIG. 8 is switched on and switched off through electrothermal actuation.

FIG. 8(*a*) illustrates a switch-on state, that is, a programmed state. When a voltage no less than operation voltage is applied between a 2-1 electrode 220-1 and a 2-2 electrode 220-2, which jointly composes the second electrode or the upper electrode, the center of an engineered beam 220-3 or a contact part 227 provided on the corresponding region are bent downward due to the thermal expansion caused by joule heat. Accordingly, a connection region or the contact part 227 is brought into a programmed state while coming into contact with a first electrode 210.

FIG. 8(*b*) illustrates a switch-off state, that is, an erased state. When a voltage is applied between body parts 222 and 223 of the 2-1 electrode 220-1, current flows between a first member 222 and a second member 223, and thermal expansion may occur due to joule heat. In addition, when voltage is applied between body parts 226 and 225 of a 2-2 electrode 220-2, current flows between a first member 225 and a second member 226, and thermal expansion may occur due to joule heat. The thermal expansion due to the current flowing in the body parts 222 and 223 of the 2-1 electrode 220-1 and the thermal expansion due to the current flowing in the body parts 225 and 226 of the 2-2 electrode 220-2 generate a rotary force on the engineered beam 220-3 due to the stepped structure, and the center or the contact part 227 of the engineered beam 220-3 is separated from the first electrode 210 and is brought into an erased state.

Such the operation is performed by the two symmetric concave-shape (V-shape, U-shape, or C-shape) body parts that mirrors each other, the engineered beam and the contact part 227, which has the dimple part 227*c*. That is, the disposition plane of the contact part 227 is positioned below the disposition plane of both end sections of the engineered beam 220-3, so that a thermal expansion force generated in the engineered beam 220-3 deflects the engineered beam 220-3 downward. In addition, the thermal expansion force occurring in the concave shape structure of the body part creates a tensile force that deflects the engineered beam 220-3 upward.

In the bottom end of FIG. 8, processes of the off state, on switching, on state, and off switching are sequentially illustrated. The switch states in the respective steps are as follows.

(i) State-off: State-off is the state in which the first electrode 210 and the second electrode 220 are physically spaced apart. Since the leakage current flowing between the two electrodes is zero, static power consumption may be extremely lowered.

(ii) Switch-on: Switch-on is the step for bringing the first electrode and the second electrode 220 into contact through thermal expansion due to the current flowing in the engineered beam 220-3 positioned at the center. When a very short electric pulse is applied to the engineered beam 220-3 at the center, joule heat is generated. At this point, heat is isolated only in the central portion of the center beam by heat isolation phenomena of nanostructures, and contact occurs between electrodes while thermal expansion is prompted in the downward direction by the structure of the engineered beam 220-3.

(iii) Stay-on: Stay-on is the state in which the first electrode 210 and the second electrode 220 are stuck via the adhesion force without additional energy consumption after the switch-on operation. The on-state may be maintained by designing the adhesion force between the contact surfaces (227*c* and 210) to be greater than the restoring force of the center beam 220-3. Since the contact state due to the adhesion force is maintained even without applying a voltage, the device may be used as a non-volatile memory.

(iv) Switch-off: The engineered beam 220-3 positioned at the center is pulled from both sides via thermal expansion due to the current flowing only in the concave mirror-type body parts facing each other, and the second electrode 220 is separated from the first electrode 210.

When brought into the switch-on state, the temperature of the engineered beam rises, the positional displacement of the contact part is instigated as the central part or the contact part 227 of the engineered beam 220-3 is bent downward. At this point, as described above, the stay-on state may be achieved by the design of the restoration force and the adhesion force.

In the switch-off operation state, it may be found that the temperature of the concave body part rises, and an upward displacement is generated with respect to the engineered beam 220-3 including the contact part 227 and the engineered beam returns to the original position as the upward thermal expansion force generated in the concave body part overcomes the adhesion force between the contact surfaces.

A memory to which a switching device in accordance with the present invention should maintain a state, in which an upper electrode and a lower electrode come into contact with each other due to the adhesion force occurring during the contact, that is, a programmed '1' state. Thus, a design is required so that the adhesion force is larger than the restoration force of the structure. At this point, the thickness and strength of the central part is intentionally increased by adopting as part of the engineered beam structure 220-3 a dimple part as described above so that the contact region 227*c* of the engineered beam 220-3 becomes resistant to bending during switch-on actuation and the contact area may be ensured. That is, the dimple part 227*c* formed in the contact part 227 may ensure the adhesion force for maintaining the stay-on state via horizontal contact of the first and second electrodes 210 and 220. Accordingly, even while a voltage is not applied, the device may have a non-volatile characteristic that maintains the '1' state.

Figure 9:
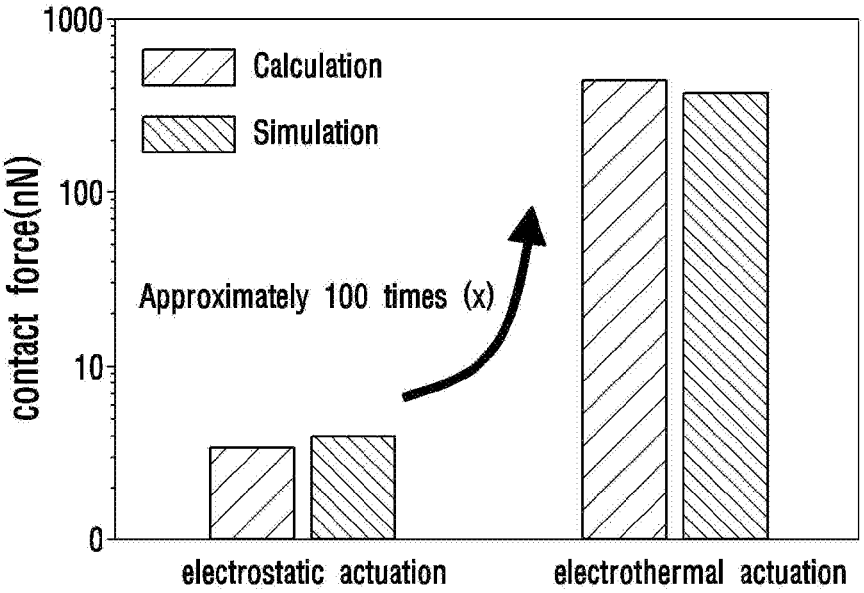
FIG. 9 is a graph comparing a contact force of a switching device in accordance with an exemplary embodiment of the present invention with that in a typical method.

FIG. 9 is a graph comparing the contact force of switching devices 100 and 200 in accordance with the present invention with that in a typical method. In FIG. 9, x-axis indicates each of typical electrostatic actuation and electrothermal actuation methods, and y-axis indicates contact force (unit: nN). Both in calculation and in simulation, a contact force approximately 100 times larger than the typical electrostatic actuation may be achieved by the electrothermal actuation in accordance with the present invention. Below is the equation indicating the relationship between contact resistance and contact force.

$$R_c = \frac{\sqrt{\pi}}{2} \times \rho \sqrt{\frac{H}{F_c}} \quad \text{[Equation 1]}$$

Rc: contact resistance, H: material hardness, p: material resistivity, Fc: contact force Low contact resistance (<3Ω) may be expected through a high contact force (approximately 100 times) of electrothermal actuation, and heat generation between contact surfaces may be reduced by lowering the contact resistance, and thus, high reliability may be expected in the switching device and the memory application using the same in accordance with an exemplary embodiment of the present invention.

Figure 10:
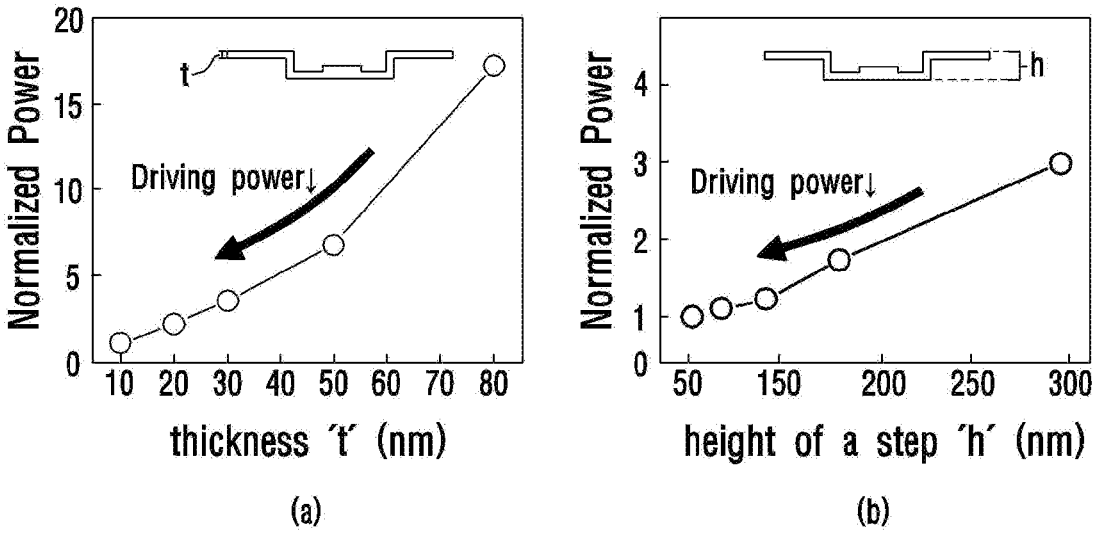
FIG. 10 illustrates an effect in terms of operation power of a switching device in accordance with an exemplary embodiment of the present invention.

FIG. 10 illustrates an effect in terms of operation power of a switching device in accordance with the present invention. FIG. 10(*a*) is a graph illustrating operation power according the thickness t of a dimple part 127*c*, and FIG. 10(*b*) is a graph illustrating operation power according to the heights h of stepped parts 127*a* and 127*b*.

A switching device in accordance with the present invention basically has operation power lower than that in a typical art, but it is also possible to optimize the operation power through a design change about the thickness t of the dimple part 127*c* and the heights h of the stepped parts 127*a* and 127*b*.

Meanwhile, a memory device in accordance with the present invention includes switching devices 100 and 200 described above and a controller. The switching devices 100 and 200 have been described in detail, and the operation method of the memory device will be simply described here.

The memory device in accordance with an exemplary embodiment of the present invention includes a first electrode and a second electrode. Here, the second electrode may include a body part and a cantilever connected to the body part. The memory device in accordance with the present invention operates in a programmed state and an erased state according to electrostatic force and electrothermal force, respectively, as heat generated by voltage applied to the first electrode and the second electrode.

In case of a memory device that employs the switching device 100 illustrated in FIGS. 1 and 2, one end of a cantilever provided to a second electrode and a first electrode are brought into contact on the basis of the electrostatic force generated by a voltage applied between the first electrode and the second electrode, and operates in a programmed state, and the one end of the cantilever is separated from the first electrode on the basis of joule heat generated by the voltage applied to both ends of the body parts of the second electrode, and operates in an erased state.

In case of a memory device that employs the switching device 200 illustrated in FIG. 5, a second electrode includes a 2-1 electrode, a 2-2 electrode, and an engineered beam, wherein the engineered beam is connected between a body part of the 2-1 electrode and a body part of the 2-2 electrode, the engineered beam comes into contact with the first electrode on the basis of thermal expansion due to heat generated by current flowing between the body part of the 2-1 electrode and the body part of the 2-2 electrode, and operates in a programmed state, and the engineered beam is separated from the first electrode on the basis of thermal expansion due to heat generated by current flowing through both ends of the body part of the 2-1 electrode and thermal expansion due to heat generated by a current flowing through both ends of the body part of the 2-1 electrode, and operates in an erased state. At this point, the engineered beam may further include: a contact part in which thermal expansion occurs downward due to the current flowing between the 2-1 electrode and the 2-2 electrode; and a dimple part protruding from a contact surface of the contact part and having a predetermined area. In particular, the contact part may be disposed between terminal parts provided to the engineered beam, and the plane on which the contact part is disposed may be positioned below the plane on which both ends of the engineered beam is disposed.

An electrothermally actuated mechanical switching device and a memory device using the same in accordance with an exemplary embodiment of the present invention use a thermal actuation method that is a novel mechanism which have never been reported, and thus provide an innovative spreading effect exceeding the limits of existing memories. In addition, limits that CMOS-based memories and new memories have are broken, and it is possible to achieve ultralow power, an ultrahigh-speed operation, and an ultralow operation. Thus, as research and development of the technology relevant to the fourth industrial revolution is actively carried out, the present invention may be used as next-generation computing devices for low power operation and high-speed information processing.

Although embodiments have mainly been described, it will be understood that the embodiments do not limit the present invention, and various modifications and applications that have not been exemplified so far may be devised by those skilled in the art without departing from fundamental characteristics of the embodiments. For example, each of components specifically described in embodiments may be implemented with modification. In addition, differences related to variations and modifications should be construed to be within the scope of the present invention defined in appended claims.

What is claimed is:

1. A memory device comprising:

a first electrode; and a second electrode disposed above the first electrode, wherein the memory device operates in a programmed state or an erased state according to heat generated by a voltage applied to at least one among the first and second electrodes, wherein the second electrode comprises a first electrode portion, a second electrode portion, and a beam connecting the first electrode portion and the second electrode portion, wherein:

the beam is connected between a body part of the first electrode portion and a body part of the second electrode portion; and:

the beam comes into contact with the first electrode on the basis of thermal expansion due to heat generated by a current flowing between the body part of the first electrode portion and the body part of the second electrode portion, whereby the memory device operates in the programmed state; and/or the beam is separated from the first electrode on the basis of thermal expansion due to heat generated by current flowing between two ends of the body part of the first electrode portion and thermal expansion due to heat generated by a current flowing between two ends of the body part of the second electrode portion, whereby the memory device operates in the erased state.

2. The memory device of claim 1, wherein the beam comprises a contact part in which thermal expansion occurs downward due to a current flowing between the first electrode portion and the second electrode portion.

3. The memory device of claim 2, comprising a dimple part protruding from an upper surface of the contact part and having a predetermined area.

4. The memory device of claim 2, wherein the contact part is disposed between stepped parts provided in the beam.

5. The memory device of claim 2, wherein a plane on which the contact part is disposed is positioned lower than a plane on which both opposite ends of the beam are positioned.

6. A switching device comprising:

a first electrode; and a second electrode including a first sub-electrode, a second sub-electrode, and a beam connecting the first sub-electrode and second sub-electrode, wherein:

the first sub-electrode includes a first body including two arms connected to a first end of the beam, and the second sub-electrode includes a second body including two arms connected to a second end of the beam opposite the first end of the beam; and:

the beam is configured to contact the first electrode on the basis of thermal expansion due to heat generated by current flowing between the first body and the second body, and/or the beam is configured to separate from the first electrode on the basis of thermal expansion due to heat generated by a current flowing through the two arms of the first body and thermal expansion due to heat generated by a current flowing through the two arms of the second body.

7. The switching device of claim 6, wherein:

the first sub-electrode includes a first end node and a second end node, the first end node connected to a first end of a first one of the two arms of the first sub-electrode, and the second end node connected to a first end of a second one of the two arms of the first sub-electrode; and the second sub-electrode includes a third end node and a fourth end node, the third end node connected to a first end of a first one of the two arms of the second sub-electrode, and the fourth end node connected to a first end of a second one of the two arms of the second sub-electrode.

8. The switching device of claim 7, wherein:

the first end node and the second end node are configured to receive a voltage from a voltage source, that when applied, causes the thermal expansion due to heat generated by current flowing between the first body and the second body.

9. The switching device of claim 8, wherein:

the second end node and the fourth end node are configured to receive a voltage from a voltage source, that when applied, causes the thermal expansion due to heat generated by the current flowing through the two arms of the first body and the thermal expansion due to heat generated by the current flowing through the two arms of the second body.

10. The switching device of claim 6, wherein the beam comprises a contact part which moves downward due to current flowing between the first body and the second body.

11. The switching device of claim 10, comprising a protrusion disposed on an upper surface of the contact part and having a predetermined area.

12. The switching device of claim 10, wherein the contact part is disposed between stepped parts provided in the beam.

13. The switching device of claim 10, wherein the first electrode is disposed below a central part of the beam, and the central part of the beam is configured to move downward and contact the first electrode due to the heat generated by current flowing between the first body and the second body.

* * * * *